US007482761B2

(12) United States Patent
Yang

(10) Patent No.: US 7,482,761 B2
(45) Date of Patent: Jan. 27, 2009

(54) LIGHT EMITTING DIODE LAMP ASSEMBLY

(76) Inventor: Chen-Sheng Yang, No. 10, Lane 233, Lanchang Rd., Nanzih District, Kaohsiung (TW)

( * ) Notice: Subject to any disclaimer, the term of this patent is extended or adjusted under 35 U.S.C. 154(b) by 135 days.

(21) Appl. No.: 11/605,896

(22) Filed: Nov. 29, 2006

(65) Prior Publication Data

US 2008/0122375 A1 May 29, 2008

(51) Int. Cl.
*H05B 37/00* (2006.01)

(52) U.S. Cl. ..... 315/185 R; 315/187; 315/324; 362/800

(58) Field of Classification Search ..... 315/209 R, 315/224, 246, 291, 307, 185 R, 185 S, 187, 315/188, 193, 324, 352, 297; 362/234, 252, 362/800

See application file for complete search history.

(56) References Cited

U.S. PATENT DOCUMENTS 4,329,625 A * 5/1982 Nishizawa et al. ..... 315/158
5,463,280 A * 10/1995 Johnson ..... 315/187
5,994,845 A * 11/1999 Gibboney, Jr. ..... 315/185 S
7,250,730 B1 * 7/2007 Allen ..... 315/185 R
7,265,496 B2 * 9/2007 Allen ..... 315/185 R
2006/0125420 A1 * 6/2006 Boone et al. ..... 315/291

* cited by examiner

*Primary Examiner*—Douglas W. Owens
*Assistant Examiner*—Jimmy T Vu

(57) ABSTRACT

A light emitting diode (LED) lamp assembly comprises an LED string and a plug. The LED string comprises multiple LEDs connected together in series. The plug is connected to the LED string and an external AC power source and has a circuit board. The circuit board is mounted in the plug, turns the LED string on or off, converts AC power to DC power and comprises an AC/DC circuit, a control circuit and a switch circuit. The AC/DC circuit is connected to the external AC power source and the LED string and converts AC power to DC power to provide operating power for the LEDs. The control circuit is connected to the AC/DC circuit to regulate illumination of the LEDs. The switch circuit is connected between the LED string and the AC/DC circuit and is controlled by the control circuit to turn the LEDs on or off.

4 Claims, 5 Drawing Sheets

LIGHT EMITTING DIODE LAMP ASSEMBLY

BACKGROUND OF THE INVENTION

1. Field of the Invention

The present invention relates to a light emitting diode (LED) lamp assembly, and more particularly to an LED lamp assembly that converts AC power to DC power.

2. Description of Related Art

Lamps can be used as either lighting or decorative devices. Tungsten light bulbs are light emitting sources for conventional lamps. With reference to FIG. 4, a conventional incandescent lamp comprises multiple tungsten light bulbs (30) and a plug (40). The tungsten light bulbs (30) are connected together in series. The plug (40) is connected to the tungsten light bulbs (30) and an external AC power source to supply power to the tungsten light bulbs (30). However, tungsten light bulbs (30) have several shortcomings, such as using a lot of electricity, generating a lot of heat, having a relatively short useful life and breaking easily.

To overcome the foregoing problems, light emitting diodes (LEDs) are becoming the newest generation light emitting sources for lamps. With reference to FIG. 5, a conventional LED lamp comprises multiple LEDs (51), a plug (60) and a current-limiting resistor (52). The LEDs (51) are connected together in series. The plug (60) is connected to the LEDs (51) and an external AC power source to supply power to the LEDs (51). The current-limiting resistor (52) is connected in series between the plug (60) and the LEDs (51) and limits current flowing through the LEDs (51).

However, the conventional LED lamp as described still has the following disadvantages.

1. The resistance of the current-limiting resistor (52) corresponds to the amount of LEDs (51) because the current-limiting resistor (52) must allow enough current to flow through the LEDs (51) so the LEDs (51) emit light. Therefore, if the amount of the LEDs (51) is changed, the resistance of the current-limiting resistor (52) has to be changed based on the number of LEDs (51).

2. The LEDs (51) only use half of the AC power supplied as operating power to emit light because the AC power includes a positive half cycle and a negative half cycle. Therefore, the conventional LED lamp wastes energy because the illumination of the light emitted by the LEDs (51) is not proportional to the output of the AC power source.

To overcome the shortcomings, the present invention provides an LED lamp assembly to mitigate or obviate the aforementioned problems.

SUMMARY OF THE INVENTION

The main objective of the invention is to provide a light emitting diode (LED) lamp assembly that converts AC power to DC power.

An LED lamp assembly in accordance with the present invention comprises an LED string and a plug. The LED string comprises multiple LEDs connected together in series. The plug is connected to the LED string and an external AC power source and has a circuit board. The circuit board is mounted in the plug, turns the LED string on or off, converts AC power to DC power and comprises an AC/DC circuit, a control circuit and a switch circuit. The AC/DC circuit is connected to the external AC power source and the LED string and converts AC power to DC power to provide operating power to the LEDs. The control circuit is connected to the AC/DC circuit to regulate illumination of the LEDs. The switch circuit is connected between the LED string and the AC/DC circuit and is controlled by the control circuit to turn the LEDs on or off.

Other objectives, advantages and novel features of the invention will become more apparent from the following detailed description when taken in conjunction with the accompanying drawings.

DETAILED DESCRIPTION OF PREFERRED EMBODIMENT

Figure 1:
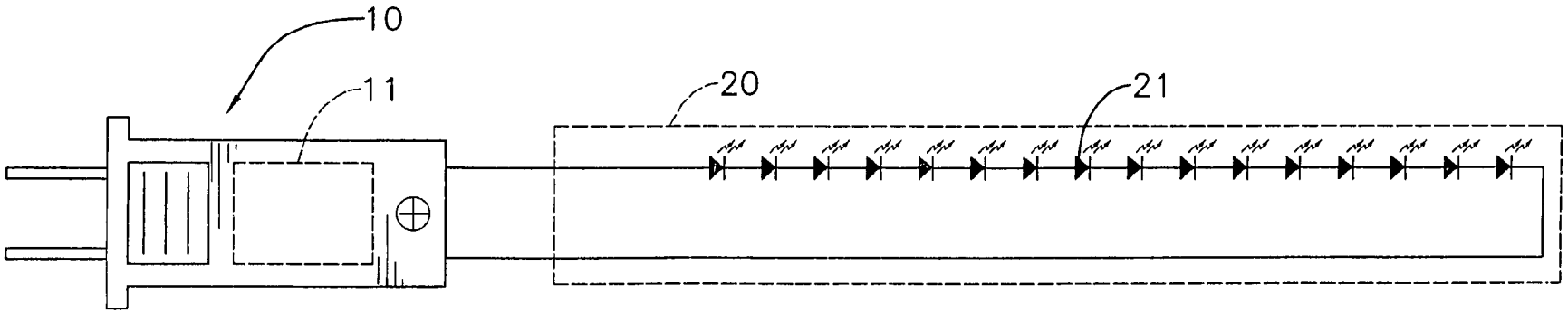
FIG. 1 is a schematic of a first embodiment of a light emitting diode lamp assembly in accordance with the present invention.

With reference to FIG. 1, a light emitting diode (LED) lamp assembly in accordance with the present invention comprises an LED string (20) and a plug (10).

The LED string (20) comprises multiple LEDs (21). The LEDs (21) are connected together in series.

Figure 2:
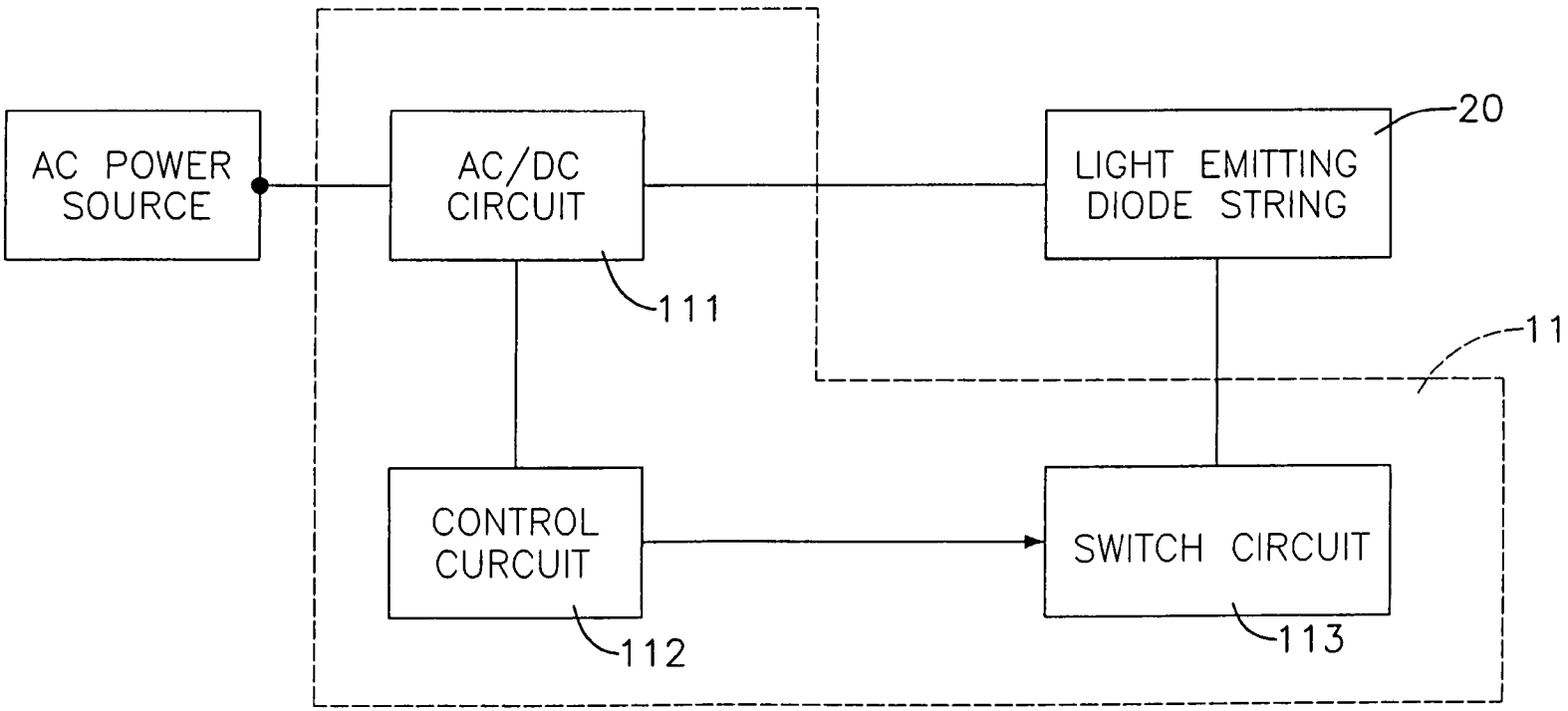
FIG. 2 is a functional block diagram of the first embodiment of the light emitting diode lamp assembly in FIG. 1.

The plug (10) is connected to the LED string (20) and an external AC power source and has a circuit board (11). With further reference to FIG. 2, the circuit board (11) is mounted in the plug (10), turns the LED string (20) on or off, converts AC power to DC power and comprises an AC/DC circuit (111), a control circuit (112) and a switch circuit (113).

Figure 3:
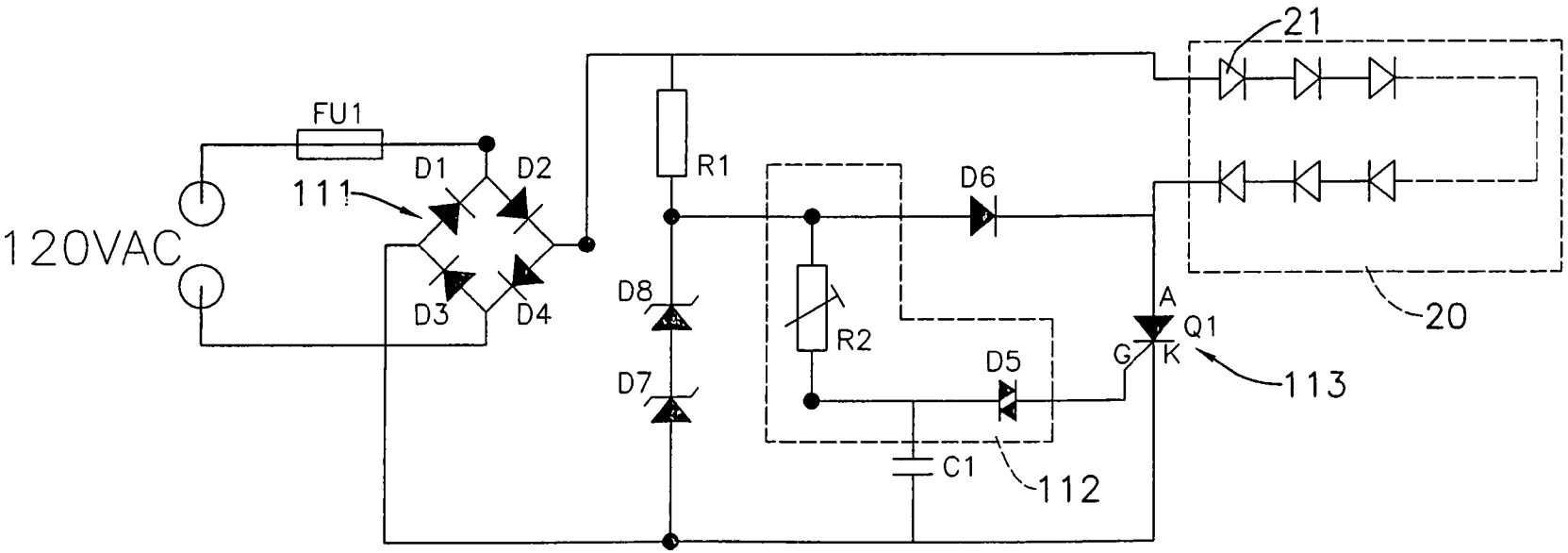
FIG. 3 is a circuit diagram of the first embodiment of the light emitting diode lamp assembly in FIG. 1.
Figure 4:
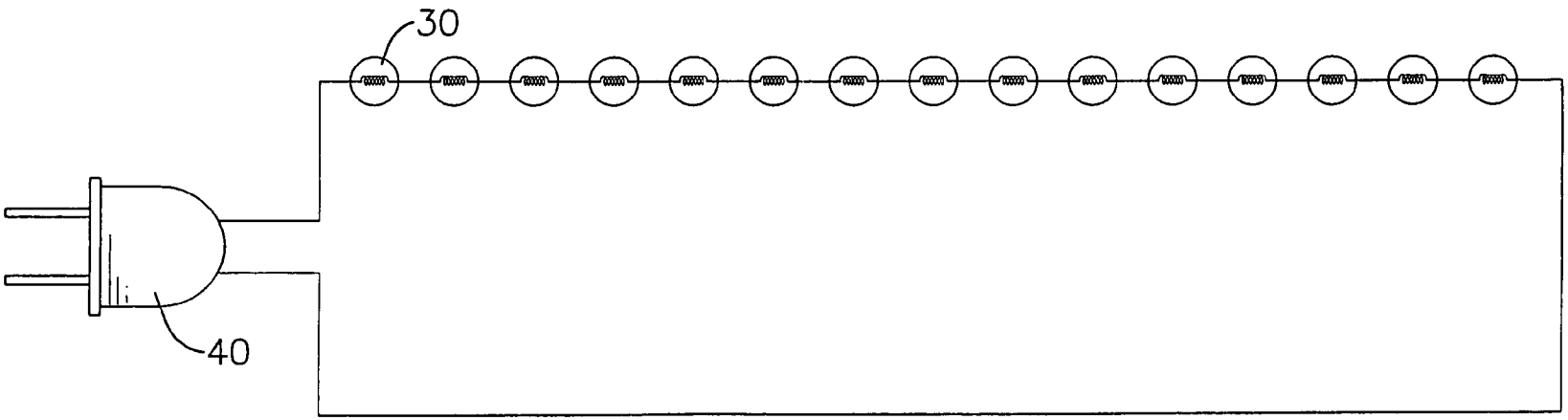
FIG. 4 PRIOR ART
FIG. 4 is a schematic a conventional lamp using tungsten light bulbs as light emitting sources.
Figure 5:
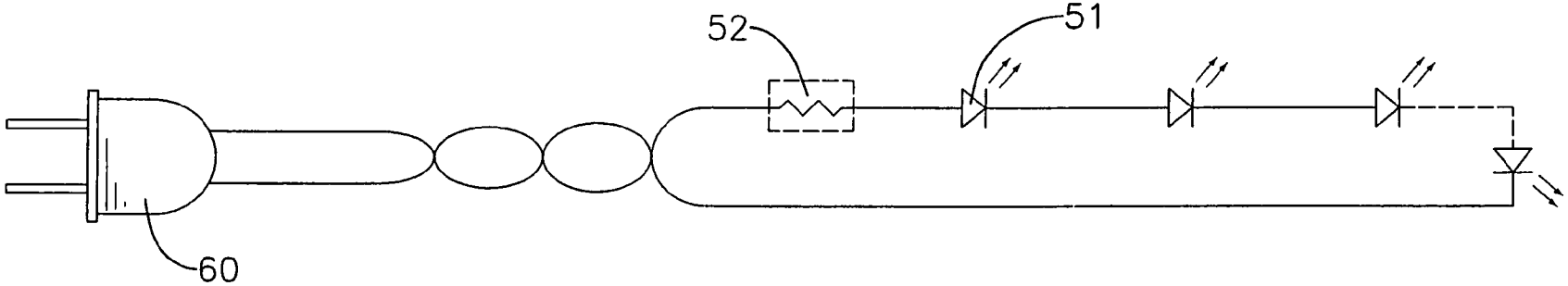
FIG.5 PRIOR ART
FIG. 5 is a schematic of a conventional lamp using light emitting diodes as light emitting sources.

With further reference to FIG. 3, the AC/DC circuit (111) is connected to the external AC power source and the LED string (20), converts AC power to DC power to provide operating power to the LEDs (21) and may be a bridge rectifier (not numbered). The bridge rectifier is composed of four diodes (D1~D4).

The control circuit (112) is connected to the AC/DC circuit (111) to regulate illumination of the LEDs (21) and may comprise a variable resistor (R2), a capacitor (C1) and a diode alternating current switch (DIAC) (D5).

The variable resistor (R2) is connected to the AC/DC circuit (111).

The capacitor (C1) and the DIAC (D5) are connected in parallel to the variable resistor (R2).

The switch circuit (113) is connected between the LED string (20) and the AC/DC circuit (111), is activated by the control circuit (112) to turn the LEDs (21) on or off and may be a silicon controlled rectifier (SCR).

The SCR has an anode terminal (A), a cathode terminal (K) and a gate terminal (G). The anode terminal (A) is connected to the LED string (20). The cathode terminal (K) is connected to the AC/DC circuit (111). The gate terminal is connected to the DIAC (D5) in the control circuit (112).

The variable resistor (R2) and the capacitor (C1) constitute a RC charge/discharge circuit. When the capacitor (C1) is charged at a voltage level that triggers the DIAC (D5), the DIAC (D5) is driven into breakdown and turns the SCR on. Accordingly, the LED string (20) and the AC/DC circuit (111) becomes a circuit, and the LED string (20) obtains operating power from the AC/DC circuit (111). In addition, the variable resistor (R2) can be used to regulate the illumination of the LEDs (21) because the charge/discharge cycle of the capacitor (C1) is determined by the variable resistor (R2). When the resistance of the variable resistor (R2) is lower, the charge/discharge cycle of the capacitor (C1) is shorter, and the LEDs (21) look brighter. When the resistance of the variable resistor (R2) is higher, the charge/discharge cycle of the capacitor (C1) is longer, and the LEDs (21) look darker.

With such an LED lamp assembly, the illumination of the LEDs (21) is brighter because the AC/DC circuit (111) converts AC power to DC power. In addition, the illumination of the LEDs (21) can also be adjusted by the variable resistor (R2). Furthermore, all the circuits (111, 112, 113) are hidden from view because the circuit board (11) is mounted in the plug (10). Therefore, all the circuits (111, 112, 113) can be protected to avoid damage.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A light emitting diode lamp assembly comprising:

a light emitting diode (LED) string comprising multiple light emitting diodes (LEDs) connected in series; and a plug connected to the LED string and an external AC power source and having a circuit board mounted in the plug, turning the LED string on or off, converting AC power to DC power and comprising an AC/DC circuit connected to the external AC power source and the LED string and converting AC power to DC power to provide operating power for the LEDs;

a control circuit connected to the AC/DC circuit to regulate illumination of the LEDs; and a switch circuit connected between the LED string and the AC/DC circuit, activated by the control circuit to turn the LEDs on or off and being a silicon controlled rectifier (SCR) having an anode terminal connected to the LED string;

a cathode terminal connected to the AC/DC circuit; and a gate terminal connected to the control circuit.

2. The light emitting diode lamp assembly as claimed in claim 1, wherein the control circuit comprises a variable resistor connected to the AC/DC circuit;

a capacitor connected to the variable resistor; and a diode alternating current switch (DIAC) connected to the variable resistor in parallel with the capacitor.

3. The light emitting diode lamp assembly as claimed in claim 2, wherein the AC/DC circuit is a bridge rectifier.

4. The light emitting diode lamp assembly as claimed in claim 1, wherein the AC/DC circuit is a bridge rectifier.

* * * * *